US008074406B2

(12) United States Patent
Ksenych et al.

(10) Patent No.: US 8,074,406 B2
(45) Date of Patent: Dec. 13, 2011

(54) MODULAR SECONDARY CONTAINMENT SYSTEM

(76) Inventors: Nick Ksenych, Watertown, SD (US); Todd N. Ksenych, Watertown, SD (US)

( * ) Notice: Subject to any disclaimer, the term of this patent is extended or adjusted under 35 U.S.C. 154(b) by 41 days.

(21) Appl. No.: 12/770,425

(22) Filed: Apr. 29, 2010

(65) Prior Publication Data

US 2011/0265405 A1 Nov. 3, 2011

(51) Int. Cl.
*E02D 27/00* (2006.01)

(52) U.S. Cl. ..... 52/169.7; 52/155; 4/506

(58) Field of Classification Search ..... 52/169.7, 52/169.1, 155, 169.8; 256/24, 25; 4/506
See application file for complete search history.

(56) References Cited

U.S. PATENT DOCUMENTS

| | | | | |
|---|---|---|---|---|
| 3,256,532 | A * | 6/1966 | Lindsey et al. | 52/284 |
| 3,302,412 | A | 2/1967 | Hunsucker | |
| 3,335,430 | A * | 8/1967 | Schwarz et al. | 4/506 |
| 3,444,659 | A * | 5/1969 | Shanni | 52/149 |
| 3,466,676 | A * | 9/1969 | Barrera | 52/169.7 |
| 3,654,640 | A * | 4/1972 | Katzman | 52/241 |
| 4,020,509 | A * | 5/1977 | West | 52/169.7 |
| 4,124,907 | A * | 11/1978 | Laven | 52/169.7 |
| 4,137,576 | A * | 2/1979 | Greene | 52/73 |
| 4,407,612 | A | 10/1983 | Van Weele | |
| 4,562,603 | A * | 1/1986 | Paradis | 4/506 |
| RE32,181 | E * | 6/1986 | Glonek et al. | 4/506 |
| 4,917,543 | A | 4/1990 | Cole | |
| 4,960,222 | A | 10/1990 | Fields | |
| 5,002,195 | A | 3/1991 | Lasson | |
| 5,106,233 | A | 4/1992 | Breaux | |
| 5,154,312 | A | 10/1992 | Robbins | |
| 5,209,603 | A | 5/1993 | Morgan | |
| 5,282,546 | A | 2/1994 | Bauer | |
| 5,360,293 | A | 11/1994 | Breaux | |
| 5,524,781 | A | 6/1996 | Podd | |
| 6,053,666 | A | 4/2000 | Irvine | |
| 7,984,519 | B1 * | 7/2011 | Hall | 4/507 |
| 2005/0091934 | A1 * | 5/2005 | Kantor | 52/155 |
| 2006/0107605 | A1 * | 5/2006 | Krahn | 52/155 |

FOREIGN PATENT DOCUMENTS

| | | |
|---|---|---|
| CA | 2362105 | 11/2001 |

OTHER PUBLICATIONS

Suretuf Containments; www.suretuf.corn; Pipeline News; Nov. 2009, Estevan, Saskatchewan; Patent No. 2,362,105.

* cited by examiner

*Primary Examiner* — Brian Glessner
*Assistant Examiner* — Brian D Mattei
(74) *Attorney, Agent, or Firm* — Neustel Law Offices

(57) ABSTRACT

A modular containment system for forming a defined perimeter around liquid storage tanks or the like. The containment system generally includes a plurality of wall panels, a corner joint removably connecting adjacent corner wall panels in angular disposition, wherein the corner joint includes an anchor pad for placement beneath and for being connected to the corner wall panels, and a support unit comprised of a gusset and anchor pad for connecting and supporting the wall panels along a straight line. The wall panels, corner joint, and support unit are each preferably comprised of an integral one-piece structure and a galvanized steel material. The wall panels, corner joint, and support unit are removably connected via interlocking wedges. A liner is generally secured along an interior of the wall panels via a retaining cap. Various braces and brackets are also used to removably connect the components of the containment barrier.

16 Claims, 6 Drawing Sheets

MODULAR SECONDARY CONTAINMENT SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a containment unit and more specifically it relates to a modular secondary containment system for efficiently forming a defined perimeter around liquid storage tanks or the like.

2. Description of the Related Art

Any discussion of the related art throughout the specification should in no way be considered as an admission that such related art is widely known or forms part of common general knowledge in the field.

Often with large liquid storage tanks, such as used by petroleum companies in oil fields, etc., there is a need to provide a secondary containment unit around the liquid storage tank to prevent the liquid from being substantially lost if failure were to occur to the liquid storage tank. Generally, the secondary containment units are constructed in a fixed or non modular manner thus requiring extensive assembly and dismantling during setup and removal processes.

In addition, the secondary containment units often must be painted to prevent corrosion, etc. and/or welded to secure adjacent walls of the containment unit together which may be time consuming, expensive, and require the use of many different types of tools and machinery. Because of the inherent problems with the related art, there is a need for a new and improved modular secondary containment system for efficiently forming a defined perimeter around liquid storage tanks or the like.

BRIEF SUMMARY OF THE INVENTION

A system for efficiently forming a defined perimeter around liquid storage tanks or the like. The invention generally relates to a containment unit which includes a plurality of wall panels, a corner joint removably connecting adjacent corner wall panels in angular disposition, wherein the corner joint includes an anchor pad for placement beneath and for being connected to the corner wall panels, and a support unit comprised of a gusset and anchor pad for connecting and supporting the wall panels along a straight line. The wall panels, corner joint, and support unit are each preferably comprised of an integral one-piece structure and a galvanized steel material. The wall panels, corner joint, and support unit are removably connected via interlocking wedges. A liner is generally secured along an interior of the wall panels via a retaining cap. Various braces and brackets are also used to removably connect the components of the containment barrier.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
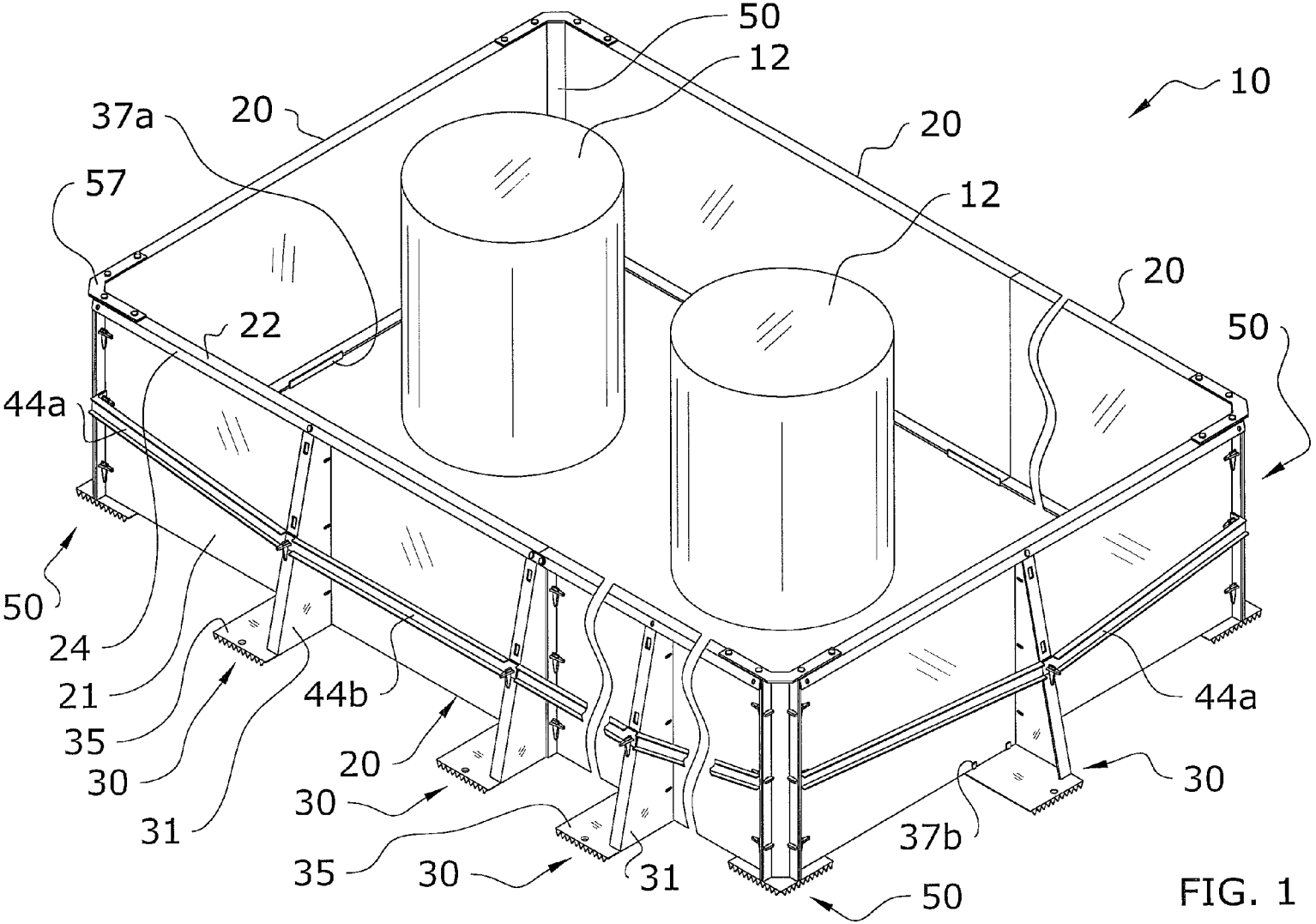
FIG. 1 is an upper perspective view of the present invention in an assembled state.

A. Overview.

Turning now descriptively to the drawings, in which similar reference characters denote similar elements throughout the several views, FIGS. 1 through 6 illustrate a modular secondary containment system 10, which comprises a plurality of wall panels 20, a corner joint 50 removably connecting adjacent corner wall panels 20 in angular disposition, wherein the corner joint 50 includes an anchor pad for placement beneath and for being connected to the corner wall panels 20, and a support unit 30 comprised of a gusset 31 and anchor pad for connecting and supporting the wall panels 20 along a straight line. The wall panels 20, corner joint 50, and support unit 30 are each preferably comprised of an integral one-piece structure and a galvanized steel material. The wall panels 20, corner joint 50, and support unit 30 are removably connected via interlocking wedges 18*a*, 18*b*. A liner 60 is generally secured along an interior of the wall panels 20 via a retaining cap 62. Various braces 44*a*, 44*b*, 49 and brackets 40 are also used to removably connect the components of the containment barrier 10.

B. Wall Panels.

The present invention includes a plurality of wall panels 20 to surround the storage tanks 12. The storage tanks 12 may be those to hold oil, fuel, or other types of liquids. Alternately, the storage tanks 12 may hold solid materials or be comprised of various other structures rather than conventional storage tanks. The panels 20 are preferably comprised of an integral structure, such that the metal, etc. used to comprise the panels 20 is bent along the sides rather than pieces welded or connected together. The panels 20 are also preferably comprised of a galvanized steel material to prevent corrosion and eliminate the need for painting the panels 20. The panels 20 may be comprised of various sizes all which extend a sufficient distance upwards to contain any escaped liquid and allow for a plurality of connected panels 20 to surround the storage tanks 12 or to complete a barrier 10 around the storage tanks 12. Each of the panels 20 is preferably identical thus providing a minimal amount of different parts to ease construction and storage processes.

Each of the panels 20 generally includes a body 21 comprised of a substantially planar and sheet-like structure. The body 21 is preferably rectangular shaped; however various shapes may be appreciated. The body 21 of the panel 20 is also generally oriented in an upright orientation.

Rearwardly extending from a top end of the body 21 in a perpendicular manner is a top member 22 that forms a top surface along the wall panel 20. The top member 22 is generally comprised of a thin plate-like structure similar to the body, wherein the top member 22 is preferably a top portion of the body 21 bent at a perpendicular angle to form the top member 22 and has a plurality of openings 23, generally circular in shape. Extending downwardly from a rearward end of the top member 22 is a lip 24 having a plurality of openings 25, generally circular in shape, extending through each end of the lip 24 for connecting to an upper end of a support unit 30.

Rearwardly extending from the peripheral sides of the body 21 in a perpendicular manner are side members 26*a*, 26*b*. The side members 26*a*, 26*b* are generally comprised of a thin plate-like structure similar to the body 21, wherein the side members 26*a*, 26*b* are preferably a side portion of the body 21 bent at a perpendicular angle to form the side members 26*a*, 26*b*. Each of the side members 26*a*, 26*b* generally has a plurality of vertically spaced openings 27*a*, 27*b* for receiving connecting wedges 18*a*, 18*b* to connect a respective support unit 30 or corner joint 50. The openings 27*a*, 27*b* of the side members 26*a*, 26*b* are preferably horizontally oriented and are elongated to form a slot-like structure. Each of the side members 26*a*, 26*b* preferably extends from an upper most end of the body 21 to a lower most end of the body 21 along the respective peripheral sides. Each of the side members 26*a*, 26*b* are also preferably parallel and perpendicular along a forward edge to the body 21 and perpendicular along an upper edge to the top member 22.

Forwardly extending from a bottom end of the body 21 in a perpendicular manner is a bottom member 28 that forms a bottom supporting surface along the wall panel 20 to stabilize the wall panel 20 along the ground or floor surface. The bottom member 28 is generally comprised of a thin plate-like structure similar to the body 21, wherein the bottom member 28 is preferably a bottom portion of the body 21 bent at a perpendicular angle to form the bottom member 28. The bottom member 28 generally has a plurality of openings 29, generally circular in shape, extending for connecting to the corner anchor pad 54.

C. Support Units.

The present invention includes a plurality of support units 30 that are used to support interconnecting wall panels 20 that meet inwardly or between corners. The support units 30 generally extend rearwardly of the panels 20 thus being positioned on an outside of the containment barrier 10 and accessible therefrom. Like the wall panels 20, the support units 30 are preferably comprised of an integral structure, such that the metal, etc. used to comprise the support units 30 is bent along the sides rather than pieces welded or connected together.

Figure 2:
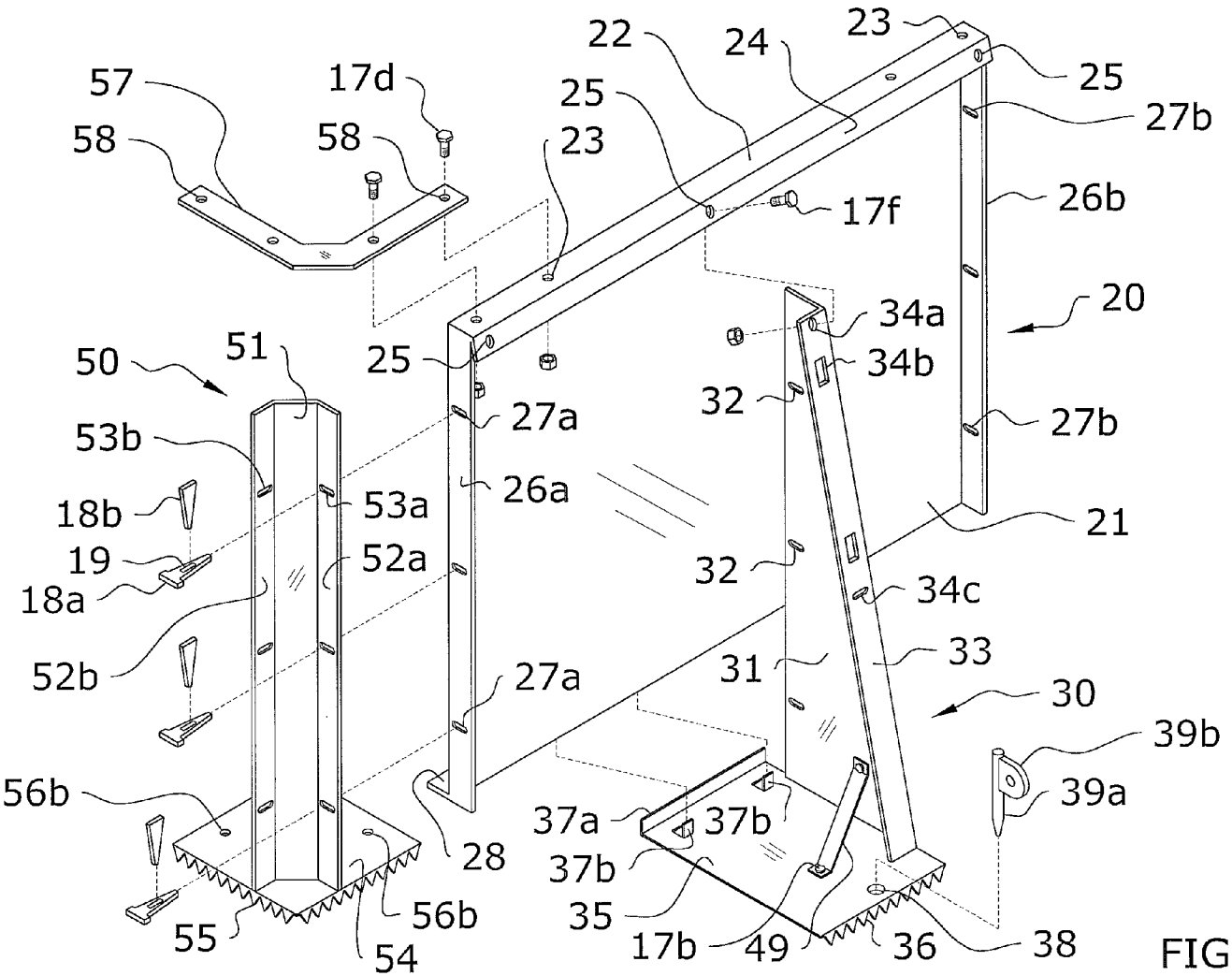
FIG. 2 is an upper perspective view of the present invention being assembled.

The support units 30 are also preferably comprised of a galvanized steel material to prevent corrosion and eliminate the need for painting the support units 30. The support units 30 may be comprised of various sizes all which sufficiently support the interconnecting wall panels 20. It is appreciated multiple support units 30 may also be used on one wall panel 20, wherein the support units 30 would be spaced between the sides of the wall panel 20 as illustrated in FIG. 2. Each of the support units 30 is preferably identical thus providing a minimal amount of different parts to ease construction and storage processes.

In the preferred embodiment, each of the support units 30 includes a gusset 31 and an anchor pad 35, wherein the gusset 31 and the anchor pad 35 are preferably comprised of an integral structure from the same piece of galvanized sheet metal and wherein the gusset 31 is bent at a perpendicular angle relative the anchor pad 35. The gusset 31 is vertically oriented and generally triangular in shape with the forward edge being perpendicular to the anchor pad 35 and extending from a height substantially equal to the side members 26*a*, 26*b* of the wall panel 20.

The gusset 31 includes a plurality of openings 32 extending through and spaced slightly inwardly from the forward edge of the gusset 31. The openings 32 of the gusset 31 are preferably horizontally oriented and elongated in structure to form a slot-like structure to align with the openings 27*a*, 27*b* of the side members 26*a*, 26*b* and be positioned between side members 26*a*, 26*b* of adjacent wall panels 20.

To connect the gusset 31 to the side members 26*a*, 26*b* of the wall panel 20, a first wedge 18*a* having a slot 19 is extended through the aligned openings 27*a*, 27*b*, 32 until the wedge 18 cannot extend any further through the openings 27*a*, 27*b*, 32 and until the slot 19 is clear past the opposing side member 26*a*, 26*b*. A second wedge 18*b* is then extended vertically through the slot 19 of the first wedge 18*a* so that a side of the second wedge 19 closest to the respective side member 26*a*, 26*b* is pressed flat against the side member 26*a*, 26*b*. Thus, the second wedge 18*b* extending through the first wedge 18*a* locks the first wedge 18*a* in place and secures the gusset 31 between the side members 26*a*, 26*b* and the adjacent panels 20 together.

The gusset 31 also generally includes a rear support 33 extending along the angled edge of the gusset 31. The rear support 33 is preferably comprised of a bent portion of the gusset 31 which is bent to form a perpendicular angle with the gusset 31. The rear support 33 has a plurality of openings 34*a*, 34*b*, 34*c* extending through.

A first opening 34*a*, generally comprised of a circular shape, extends through the upper end of the rear support 33 and is aligned with an opening 25 of the lip 24 of one of the adjacent panels 20. A straight bracket 40 having a pair of openings 41 is then located between the panels 20 to extend between openings 25 of the lips 24 of adjacent panels 20 so that one of the openings 41 of the bracket 40 aligns with the first opening 34*a* of the rear support 33 and the opening 25 of the lip 24 on one of the panels 20 and another one of the openings 41 of the bracket 40 aligns with the opening 25 of the lip 24 of the other panel 20. Fasteners 17*a*, such as bolts and corresponding nuts, are then used to secure the brackets 40 to the lips 24 of the adjacent panels 20 thus securing a top end of the panels 20 together.

A plurality of second openings 34*b* also extend through the rear support 33 and are vertically spaced along the rear support 33. The second openings 34*b* are each preferably vertically oriented and comprised of an elongated slot structure. The second openings 34*b* are for receiving a hook of a lifting device thus allowing an operator to lift and move multiple sections of the containment system 10 at one time.

At least one third opening 34*c* also extends through the rear support 33 preferably at a longitudinal center of the rear support 33. The third opening 34*c* is preferably horizontally oriented and comprised of an elongated slot structure to receive a third wedge 18*c*. The third wedge 18*c* is lodged within the third opening 34*c* so that a wide end of the third wedge 18*c* may be received (on a rearward side of the rear support 33) by an end portion 46*a*, 46*b* of a supporting brace 44*a*, 44*b*. The supporting braces 44*a*, 44*b* extend along the rearward side of the containment system 10 to provide additional support and are removably received via slots 47*a*, 47*b* of the end portions 46*a*, 46*b* receiving a respective wide end of the wedges 18*a*, 18*c*. The supporting braces 44*a*, 44*b* also each are comprised of an elongated structure to extend the length of at least one of the panels 20 and each include an elongated portion 45*a*, 45*b* comprised of a uniform width and structure.

The anchor pad 35 of the support unit 30 is positioned beneath one of more of the adjacent panels 20 and preferably positioned beneath at least a portion of both adjacent panels 20. The anchor pad 35 preferably has claws 36 extending downward at a rearward end of the anchor pad 35 to better grasp the ground surface and ensure that the wall panels 20 do not move outwards in the case of a substantial pressure being applied upon the inside of the wall panels 20, such as from escaping liquid from the storage tanks 12. The anchor pad 35 also includes at least one opening 38 along a rearward edge for optionally receiving a stake 39*a* to better secure the anchor pad 35 in a given location to the ground surface. The ground stake 39*a* has an eyelet 39*b* extending laterally outward from the upper end which allows the ground stake 39*a* to be grasped by tools or machinery to remove the ground stake 39*a* from the ground.

The anchor pad 35 also includes upwardly extending supports 37*a*, 37*b* for holding the bottom member 28 of the wall panel 20 in place and thus holding the wall panel 20 in a given location. The anchor pad 35 include a first support 37*a* extending upwardly from a forward edge of the anchor pad 35 and a plurality of bent-up second supports 37*b* spaced rearwardly from the first support 37*a*. The bottom member 28 of the wall panel 20 is received between the first support 37*a* and the second supports 37*b*.

Figure 6:
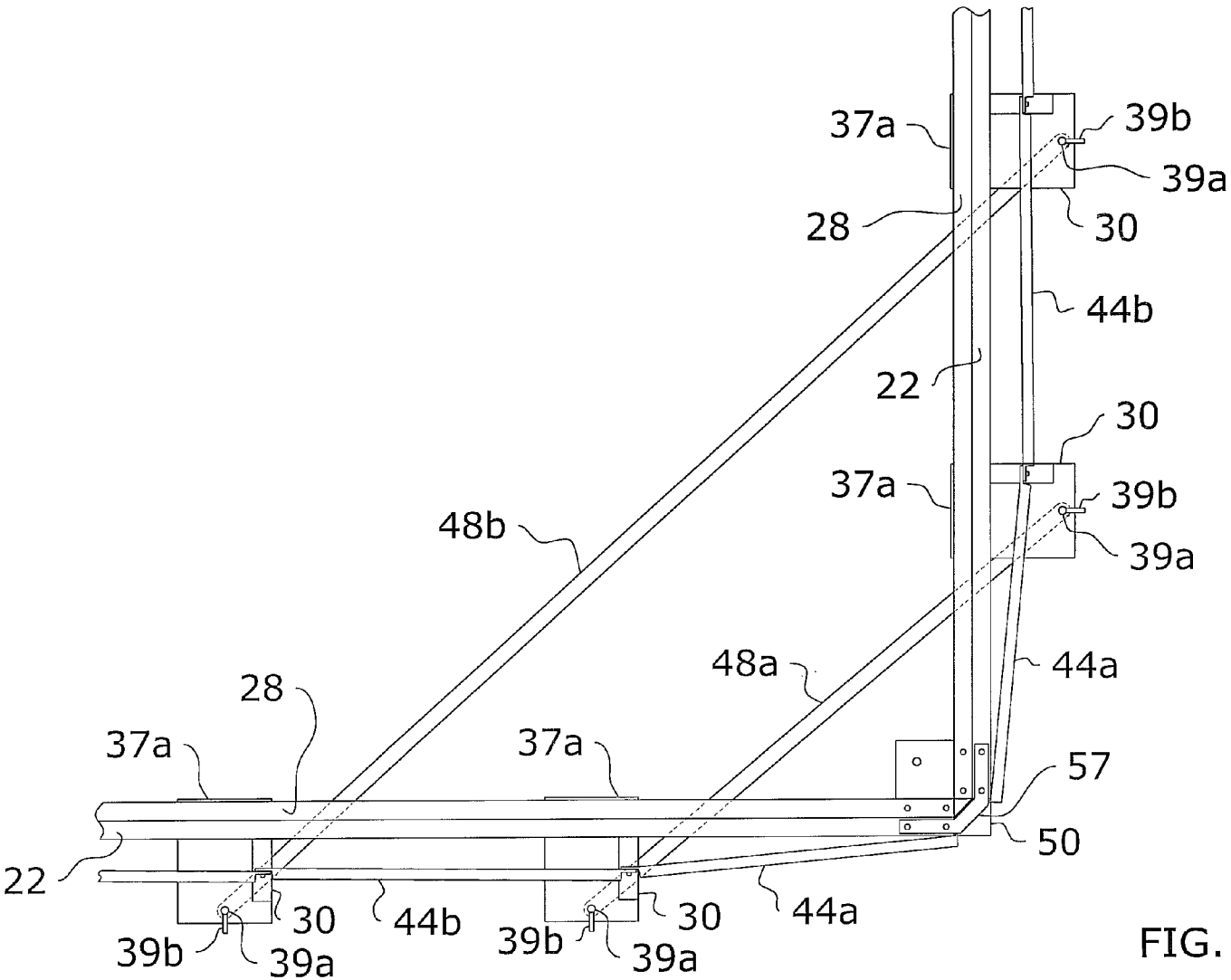
FIG. 6 is a top view of a corner assembly of the present invention.

Connecting braces 48*a*, 48*b* may connect anchor pads 35 of support units 30 on an adjacent cornering side of the containment wall 10 as illustrated in FIG. 6. The connecting braces 48*a*, 48*b* form a triangular structure with the wall panels 20 and the corner joint 50. The connecting braces 48*a*, 48*b* each include eyelets on each end for aligning with the rear openings 38 of the anchor pad 35 and receiving the ground stake 39*a* therethrough to hold the connecting braces 48*a*, 48*b* in place.

An angled brace 49 may extend between and be secured to the anchor pad 35 and the gusset 31 for additional support to the gusset 31 to keep the gusset 31 in an upright orientation and perpendicular to the anchor pad 35. The angled brace 49 includes angled ends for resting flat against the anchor pad and the gusset 31 and is generally secured to the anchor pad and the gusset 31 via fasteners 17*b*.

D. Corner Joints.

The corner joints 50 are used to connect adjacent wall panels 20 at a corner of the containment system 10 to hold the wall panels 20 in a defined angular disposition relative one another. The corner joints 50 generally hold the adjacent wall panels 20 in a 90 degree angle relative one another; however it is appreciated that the corner joints 50 may hold the adjacent wall panels 20 at various other angles relative one another.

The corner joints 50 preferably each include a center member 51 extending vertically upward a height equal to the wall panel 20 and a pair of side members 52*a*, 52*b* extending laterally and angularly outward from the center member 51 on opposing sides. The side members 52*a*, 52*b* may form a 45 degree angle with the center member 51, such as when the corner joint 50 is used to angularly dispose the wall panels 20 in a 90 degree angle. The side members 52*a*, 52*b* may form various other angles with the center member 51 as appreciated. Each of the side members 52*a*, 52*b* also generally include an opening 53*a*, 53*b* oriented in horizontal orientation and being comprised of an elongated slot structure for receiving the first wedge 18*a* to connect the side member 52*a*, 52*b* of the corner joint 50 to the adjacent side member 26*a*, 26*b* of the wall panel 20 in a manner as previously described with the first wedge 18*a* and the second wedge 18*b*.

The corner anchor pad 54 is located beneath the center member 51 and side members 52*a*, 52*b* of the corner joint 50 to rest in a horizontal manner atop the ground surface. The anchor pad 54 is also preferably located beneath the portions of the wall panels 20 that are adjacent the corner joint 50 so that the wall panels 20 are held at a similar height as the corner joint 50. The anchor pad 54 preferably has claws 55 extending downward at a rearward end of the anchor pad 54 to better grasp the ground surface and ensure that the wall panels 20 and corner joint 50 do not move outwards in the case of a substantial pressure being applied upon the inside of the wall panels 20 and/or corner joint 50, such as from escaping liquid from the storage tanks 12. The anchor pad 54 also includes at least one opening 56*a* along a forward edge for optionally receiving a stake 59*a* to better secure the anchor pad 54 in a given location to the ground surface. The ground stake 59*a* has an eyelet 59*b* extending laterally outward from the upper end which allows the ground stake 59*a* to be grasped by tools or machinery to remove the ground stake 59*a* from the ground. The anchor pad 54 also preferably includes a plurality of second openings 56*b* for aligning with the openings 29 of the bottom member 28 of the wall panel 20 and receiving a fastener 17*c* therethrough to secure the wall panels 20 to the corner anchor pad 54.

An upper brace 57 is also preferably utilized at the corner of the containment system 10 for securing an upper end of the adjacent wall panels 20 at the corner. The upper brace 57 is preferably comprised of an -shaped structure or other shaped structure to match the shape of the adjacent wall panels 20 and the corner joint 50. The upper brace 57 includes a plurality of openings 58 to align with openings 23 extending through the top member 22 of the wall panel 20 and receive fasteners 17*d* therethrough.

E. Liner.

A non permeable liner 60 is preferably located along an inner side of the containment system 10 so that a lower end of the liner 60 drapes along the ground surface inside of the containment system 10 and an upper end of the liner 60 is draped over the top member 22 of the wall panels 20. The liner 60 helps to prevent liquid within the containment barrier 10 from escaping through the wall panels 20.

Figure 5:
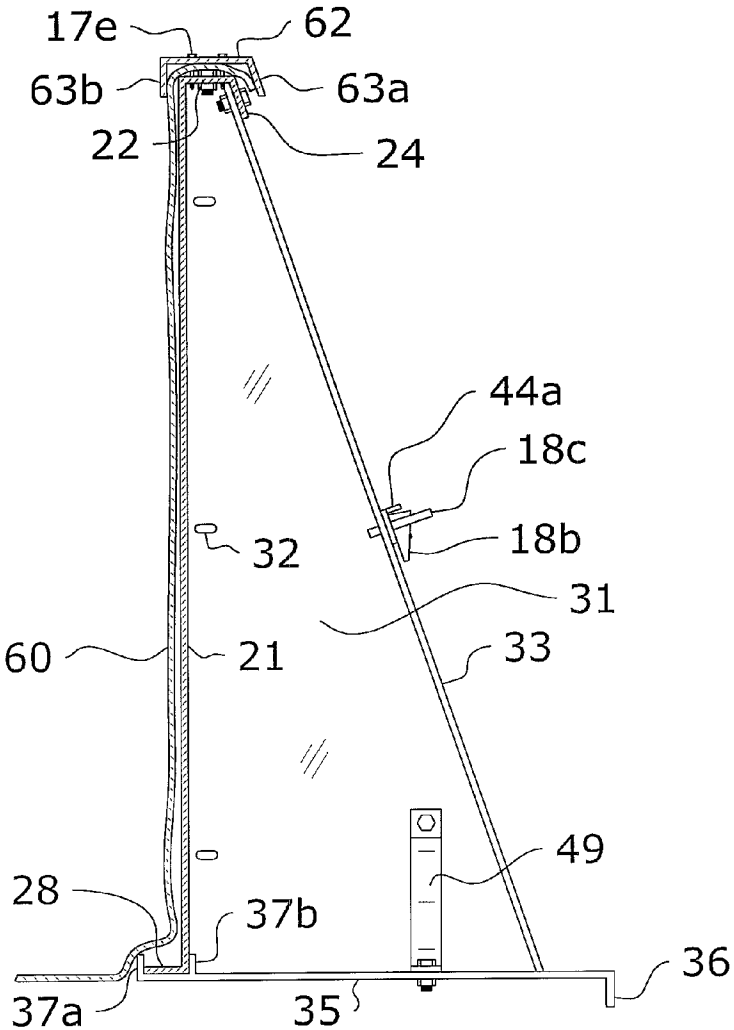
FIG. 5 is a side sectional view of the wall panel and support unit with the liner attached and secured over the top of the wall panel with the end cap.

The upper end of the liner 60 is secured to the wall panels 20 via retaining caps 62 positioned atop the liner 60 and sandwiching the liner 60 between the retaining cap 62 and the top member 22 of the wall panels 20 as illustrated in FIG. 5. The retaining cap 62 has angled lips 63*a*, 63*b* to match the correlating angle of the wall panel 20 and/or gusset 31. The retaining cap 62 may also include openings to receive self-tapping fasteners 17*e* which are extended through the liner 60 or openings in the liner 60 and then through the top member 22 of the wall panel 20 to secure the retaining cap 62 thereto.

F. Operation and Assembly of Preferred Embodiment.

Figure 3:
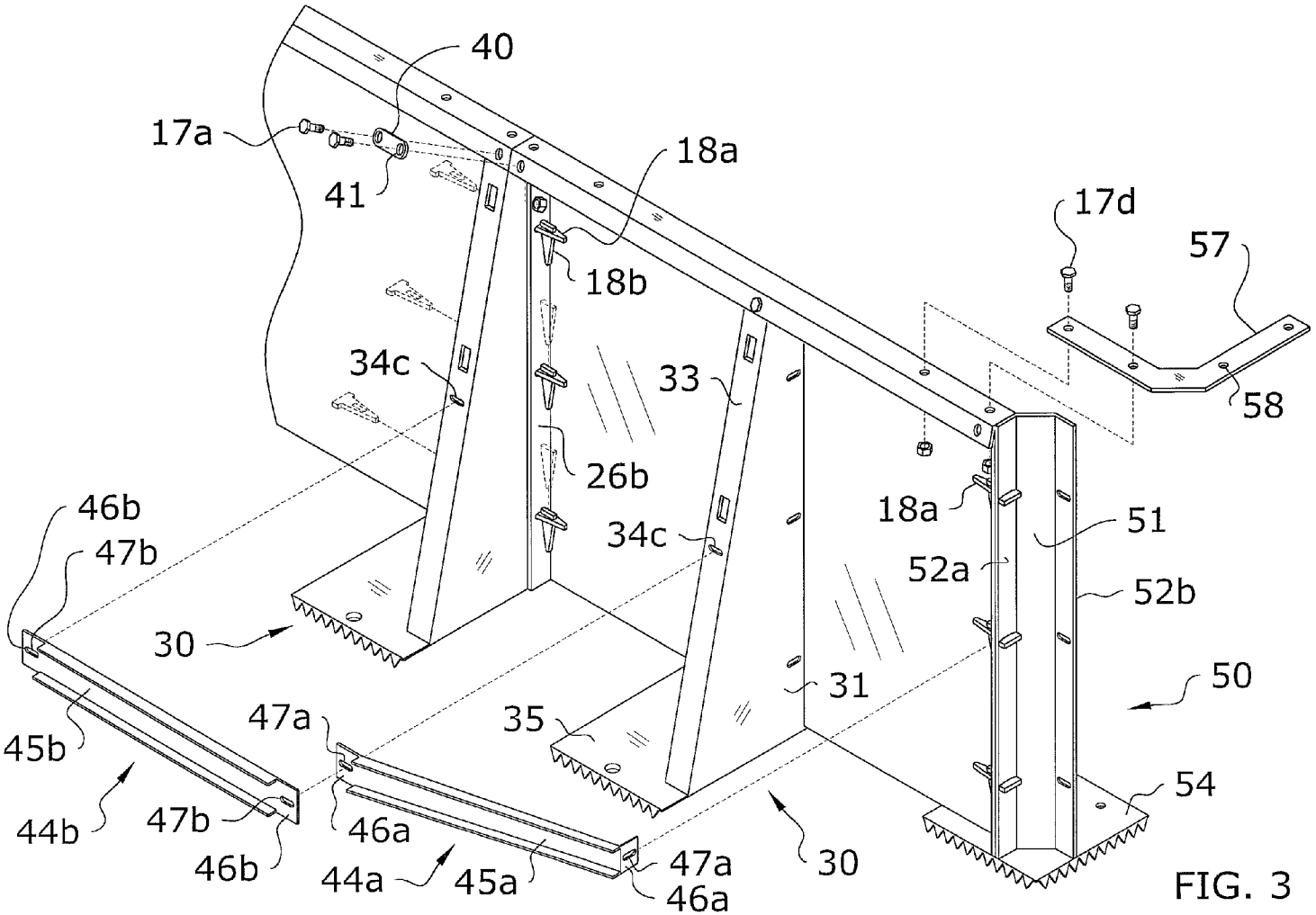
FIG. 3 is another upper perspective view of the present invention being assembled.
Figure 4:
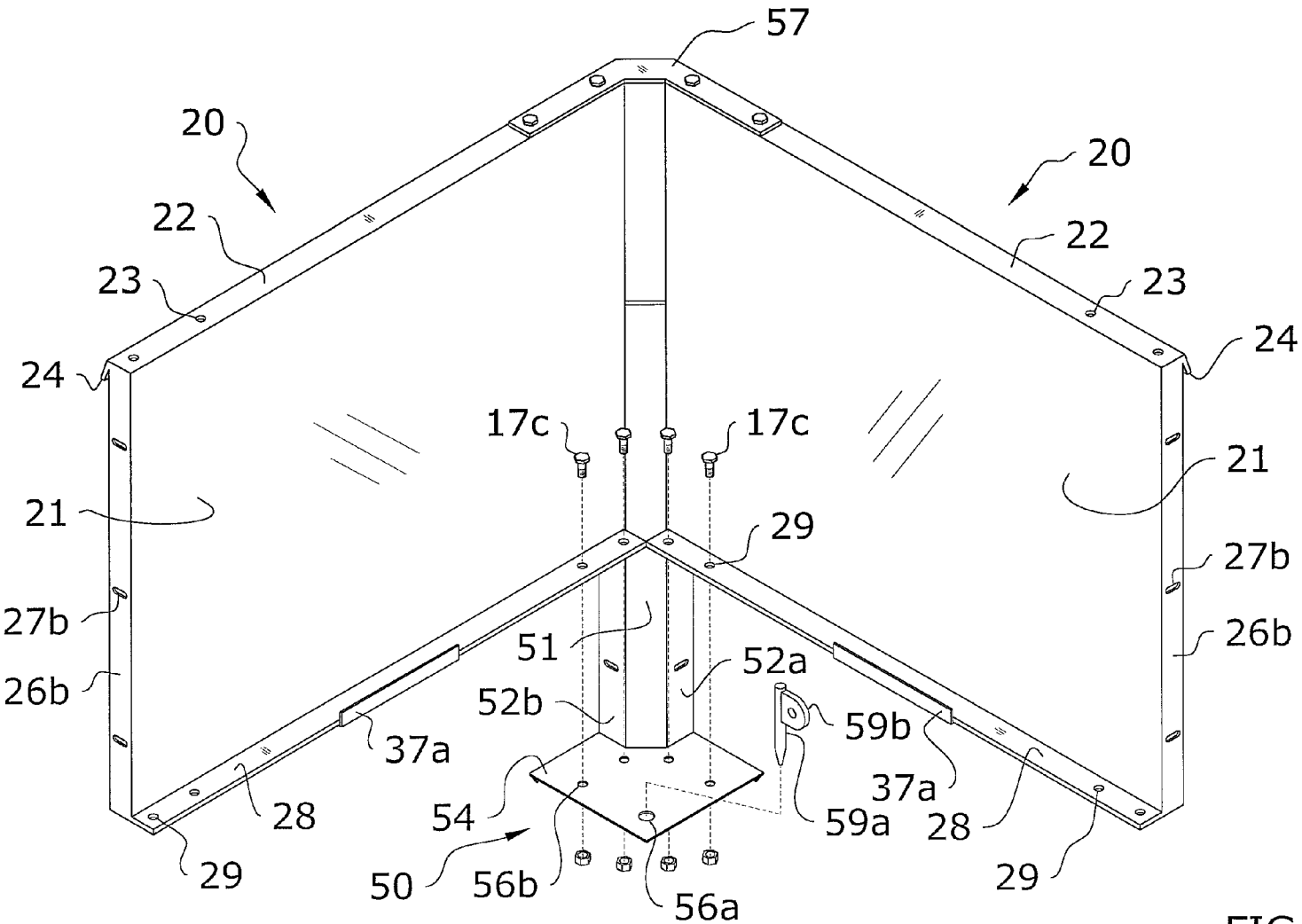
FIG. 4 is an upper perspective view of the interior of the present invention with the corner joint and anchor pad being secured to the wall panels.

In use, the prefabricated wall panels 20 are arranged in the desired sequence to contain or surround the liquid storage tanks 12. At the corners, the corner joint 50 is positioned between adjacent wall panels 20 and attached thereto using the first wedge 18*a* and the second wedge 18*b* as illustrated in FIGS. 2 and 3. The corner anchor pad 54 is also located beneath the corner joint 50 and extends beneath an adjacent portion of the adjacent wall panels 20. The openings 56*b* of the corner anchor pad 54 are aligned with the openings 29 of the bottom member 28 of the wall panels 20 and secured thereto via fasteners 17*c*. Optionally, a ground stake 59*a* may be used to secure the corner anchor pad 54 to the ground. The upper brace 57 is also secured to the upper ends of the corner joint 50 and adjacent wall panels 20.

On every location where two wall panels 20 are jointed along a straight line (not at a corner), a support unit 30 is sandwiched between the two wall panels 20 with the forward edge of the gusset 31 positioned between opposing side members 26*a*, 26*b* of the wall panels 20 so that the openings 32 of the gusset 31 align with the openings 27*a*, 27*b* of the side members 26*a*, 26*b*. The first and second wedges 18*a*, 18*b* are then used to tightly secure the wall panels 20 and support unit 30 together.

The upper end of the support unit 30 is also positioned between the lip 24 of the wall panel 20 and the body 21 of the wall panel 20 so that the opening 34*a* at the upper end of the support unit 30 aligns with an opening 25 of the lip 24 of the wall panel 20. The bracket 40 is then aligned as illustrated in FIG. 3 to receive fasteners 17*a* and secure adjacent wall panels 20 to help maintain a straight edge between the adjacent wall panels 20. It is appreciated that the bottom member 28 of the wall panel 20 is also sandwiched between the first and second supports 37*a*, 37*b* atop the anchor pad 35.

Identical support units 30 are also located at the center of each of the wall panels 20 as illustrated in FIGS. 2 and 3 by extending the upper end of the support unit 30 between the lip 24 and the body 21 of the wall panel 20 to align openings 25, 34*a* and receive a fastener 17*f*. Like the other support units 30, the bottom member 28 of the support unit 30 is also positioned between the first and second supports 37*a*, 37*b* atop the anchor pad 35.

The reinforcement braces 44*a* are then extended between the corner joint 50 and the support unit 30 with the slots 47*a* of the end portions 46*a* of the reinforcement braces 44*a* receiving the wide end of the horizontal first wedge 18*a* connecting the corner joint 50 and wall panel 20 and the opposite end portion 46 receiving the wide end of a third wedge 18*c* extending within the support unit 30 at the longitudinal center of the wall panel 20 as illustrated in FIG. 3. Additional reinforcement braces 44*b* are extended between adjacent support units 30 to receive the wide ends of the third wedges 18*c* extending within the rear supports 33 of the support units 30. Additionally, a gusset brace 49 is connected to each support unit 30 to provide support between the gusset 31 and the anchor pad 35 as illustrated in FIG. 2.

The liner 60 can now be placed on the interior of the containment system 10 with the liner 60 panel 20 laid against the wall panels 20 and over the top member 22 of the exterior side of the wall panels 20. The liner 60 is held in place with the retaining cap 62 that is secured over the liner 60 and over the top member 22 of the wall panels 20. The caps 62 are held in place via self tapping fasteners 17*e* through the liner 60 and into the top member 22. Additional support braces (not shown) may be used to connect adjacent anchor pads 35 or adjacent anchor pads 54 as deemed necessary. The support braces may connect to similar corners on the anchor pads 35 and/or 54 to form a triangular shaped support with the assembled wall panels 20. The claws 36 and/or 55 may also be omitted in alternate embodiments to create a flat resting anchor pad 35 and/or 54.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A modular containment barrier for surrounding one or more liquid storage tanks, comprising:

at least two wall panels;

at least one corner joint removably connected to said two wall panels, wherein said corner joint connects said two wall panels in angular disposition to one another;

at least one corner anchor pad for placement beneath said corner joint and an adjacent portion of each of said two wall panels, wherein said corner anchor pad is removably connected to a lower end of said two wall panels;

at least one upper brace for placement above said corner joint and said adjacent portion of said two wall panels, wherein said upper brace is removably connected to an upper end of said two wall panels;

a plurality of first openings extending through said corner anchor pad;

a plurality of second openings extending through a bottom of each of said two wall panels, wherein said second openings align with said first openings; and a plurality of fasteners extending through said first openings and said second openings to secure a bottom end of said two wall panels to said corner anchor pad.

2. The modular containment barrier of claim 1, wherein said corner joint includes:

a center member vertically oriented;

a first side member angularly extending from said center member, wherein said first side member mates with a first side of a first wall panel of said two wall panels; and a second side member angularly extending from said center member opposite said first side member, wherein said second side member mates with a second side of a second wall panel of said two wall panels.

3. The modular containment barrier of claim 2, comprising:

at least one first opening extending through said first side member;

at least one second opening extending through said first side, wherein said first opening aligns with said second opening;

at least one first wedge having a first slot therein, wherein said first wedge horizontally extends through said first opening and said second opening so that said first slot extends past said first opening and said second opening and so a wide end of said first wedge does not extend through said first opening or said second opening;

at least one second wedge vertically extending through said first slot of said first wedge to retain said first wedge within said first opening and said second opening;

at least one third opening extending through said second side member;

at least one fourth opening extending through said second side, wherein said third opening aligns with said fourth opening;

at least one third wedge having a second slot therein, wherein said third wedge horizontally extends through said third opening and said fourth opening in so that said second slot extends past said third opening and said fourth opening and so a wide end of said third wedge does not extend through said third opening and said fourth opening; and at least one fourth wedge vertically extending through said second slot of said third wedge to retain said third wedge within said third opening and said fourth opening.

4. The modular containment barrier of claim 1, wherein said corner anchor pad includes a plurality of claws extending downward from a rearward edge.

5. The modular containment barrier of claim 1, comprising:

at least one first opening extending through said corner anchor pad, wherein said first opening is forward of said corner joint; and a ground stake extending through said first opening and within a ground surface.

6. The modular containment barrier of claim 1, wherein said upper brace is comprised of a substantially L-shaped structure.

7. The modular containment barrier of claim 6, comprising:

a plurality of first openings extending through said upper brace;

a plurality of second openings extending through a top of said two wall panels, wherein said second openings align with said first openings;

a plurality of fasteners extending through said first openings and said second openings to secure a top end of said two wall panels together in said angular disposition.

8. A modular containment barrier for surrounding one or more liquid storage tanks, comprising:

at least three wall panels;

at least one corner joint removably connected to a first and second wall panel of said three wall panels, wherein said corner joint connects said first and second wall panels in angular disposition to one another;

at least one first anchor pad for placement beneath said corner joint and an adjacent portion of each of said first and second wall panels, wherein said first anchor pad is removably connected to a lower end of said first and second wall panels;

at least one first gusset removably connected to said second wall panel and a third wall panel of said at least three wall panels, wherein said gusset is connected between said second and third wall panels; and at least one second anchor pad for placement beneath said first gusset and adjacent portions of said second and third wall panels, wherein said second anchor pad supports a lower end of said third wall panel;

a plurality of first openings extending through said first anchor pad;

a plurality of second openings extending through a bottom of each of said first and second wall panels, wherein said second openings align with said first openings; and a plurality of fasteners extending through said first openings and said second openings to secure a bottom end of said first and second wall panels to said first anchor pad.

9. The modular containment barrier of claim 8, comprising:

at least one first support extending upwardly from a forward edge of said second anchor pad; and at least one second support extending upwardly from said second anchor pad, wherein said second support is rearwardly spaced from said first support;

wherein said first support and said second support receive a bottom end of at least one of said second or third wall panels between thereof for supporting a bottom end of said second or third wall panels.

10. The modular containment barrier of claim 8, wherein said corner anchor pad includes a plurality of claws extending downward from a rearward edge.

11. The modular containment barrier of claim 8, comprising:

a first wedge for holding said second panel to said corner joint; and a second wedge extending outwardly from a rearward side of said gusset;

wherein said reinforcement brace includes slotted ends for removably receiving a portion of said first wedge and said second wedge.

12. The modular containment barrier of claim 8, comprising:

a liner draped along an interior of said containment barrier, wherein said liner is extended over a top of said three wall panels;

at least one retaining cap extending over said liner and said top of said three wall panels; and a plurality of fasteners for extending through said retainer cap and within said top of said three wall panels for sandwiching said liner between said retaining cap and said top of said three wall panels.

13. The modular containment barrier of claim 8, comprising:

at least one first opening extending through said gusset adjacent a forward edge of said gusset;

at least one second opening extending through a first side of said second wall panel;

at least one third opening extending through a second side of said third wall panel, wherein said first opening aligns with said second opening and said third opening;

at least one first wedge having a first slot therein, wherein said first wedge horizontally extends through said first opening, said second opening, and said third opening so that said first slot extends past said first opening, said second opening, and said third opening and so a wide end of said first wedge does not extend through said first opening, said second opening, or said third opening;

at least one second wedge vertically extending through said first slot of said first wedge to retain said first wedge within said first opening, said second opening, and said third opening.

14. The modular containment barrier of claim 8, including at least one bracket for connecting an upper end of said gusset to said second and third wall panels.

15. The modular containment barrier of claim 8, comprising:

at least one second gusset removably connected a substantial longitudinal center of said second wall panel between said first gusset and said corner joint;

at least one reinforcement brace removably connecting said corner joint to said second gusset; and at least one third anchor pad for placement beneath said second wall panel, wherein said third anchor pad supports a lower end of said second wall panel.

16. The modular containment barrier of claim 15, comprising:

at least one first support extending upwardly from a forward edge of said third anchor pad; and at least one second support extending upwardly from said third anchor pad, wherein said second support is rearwardly spaced from said first support;

wherein said first support and said second support receive a bottom end of said second wall panel between thereof for supporting a bottom end of said second wall panel.

* * * * *